United States Patent [19]

Credelle

[11] 4,362,966

[45] Dec. 7, 1982

[54] ELECTRON LEAKAGE REDUCTION IN FLAT PANEL DISPLAY DEVICES

[75] Inventor: Thomas L. Credelle, East Windsor, N.J.

[73] Assignee: RCA Corporation, New York, N.Y.

[21] Appl. No.: 210,741

[22] Filed: Nov. 26, 1980

[51] Int. Cl.[3] ..... H01J 29/72; H01J 29/08

[52] U.S. Cl. ..... 313/422; 315/366

[58] Field of Search ..... 313/422

[56] References Cited

U.S. PATENT DOCUMENTS 3,181,027 4/1965 Geer ..... 313/422 X

*Primary Examiner*—Robert Segal

*Attorney, Agent, or Firm*—Eugene M. Whitacre; Dennis H. Irlbeck; Lester L. Hallacher

[57] ABSTRACT

In a display device which is divided into a plurality of channels by support vanes, scanning electrodes are arranged on both sides of the vanes. The scanning electrodes are segmented in the direction of electron beam propagation and one portion of the segments is biased with a varying voltage to scan the electron beams transversely across the channels. The remaining portion of the scanning electrodes is biased to deflect leakage electrons away from the screen to thereby improve the visual display.

9 Claims, 3 Drawing Figures

ELECTRON LEAKAGE REDUCTION IN FLAT PANEL DISPLAY DEVICES

BACKGROUND OF THE INVENTION

This invention relates generally to flat panel display devices and particularly to electron leakage reduction in such devices.

U.S. Pat. No. Re. 30,195 discloses a flat panel display device in which a backplate and a faceplate are spaced in parallel planes. A plurality of vanes extend between the backplate and faceplate to divide the envelope into a plurality of channels and to support the faceplate and backplate against atmospheric pressure after the envelope is evacuated. Arranged in each of the channels is a pair of spaced apart parallel beam guide meshes which extend longitudinally along the channels and transversely across the channels. The beam guide meshes serve as guides along which electron beams are propagated the lengths of the channels.

The inside surface of the faceplate is provided with a phosphor screen which luminesces when struck by electrons. A plurality of extraction electrodes are arranged along the baseplate and are used to eject the electron beams from between the beam guide meshes to direct the electrons toward the phosphor screen. Deflection electrodes are provided on the sides of the support vanes and are electrically energized to cause the electrons to transversely scan across the channels. Accordingly, each of the channels contributes a portion of the total visual display of the device.

U.S. Pat. No. 4,117,368 discloses a flat panel display of the type described above which also includes a plurality of vanes to afford support against atmospheric pressure. Deflection electrodes are provided on both sides of the vanes so that each vane supports one deflection electrode for each of two adjacent channels. In order to avoid charging of the capacitor formed by the deflection electrodes on a single vane, adjacent channels are scanned in opposite directions. Equal scanning voltages therefore are applied to the deflection electrodes on each vane and the detrimental effects of capacitive charging are eliminated.

The inventions described in the above-referenced patents are quite satisfactory for the purpose intended. However, problems arise because of electron leakage from the beam guides. Typically, the first line scanned during the production of a visual display is the line which is furthermost from the cathode and the last line scanned is the line which is nearest to the cathode. Accordingly, the electron beams travel past the last line scanned for a substantial time period during which no line scanning takes place. The opportunity for electron leakage to the screen in the cathode area is thus substantial and a degradation of the visual display frequently results.

The instant invention overcomes the electron leakage problem and thereby greatly enhances the visual display quality.

SUMMARY OF THE INVENTION

An electron display device is divided into a plurality of channels by a plurality of vanes. Each channel longitudinally propagates electron beams along a plane which is substantially parallel to the screen of the display. Arranged transversely of the channels are means for directing the electron beams toward the screen. Scan electrodes are arranged on both sides of the support vanes and are biased to scan the directed beams transversely across the channel and each channel thus contributes to the total visual display. The scan electrodes are segmented in the direction of the electron beam propagation whereby the electron beam sequentially progagates past the segments.

DETAILED DESCRIPTION OF THE PREFERRED EMBODIMENT

Figure 1:
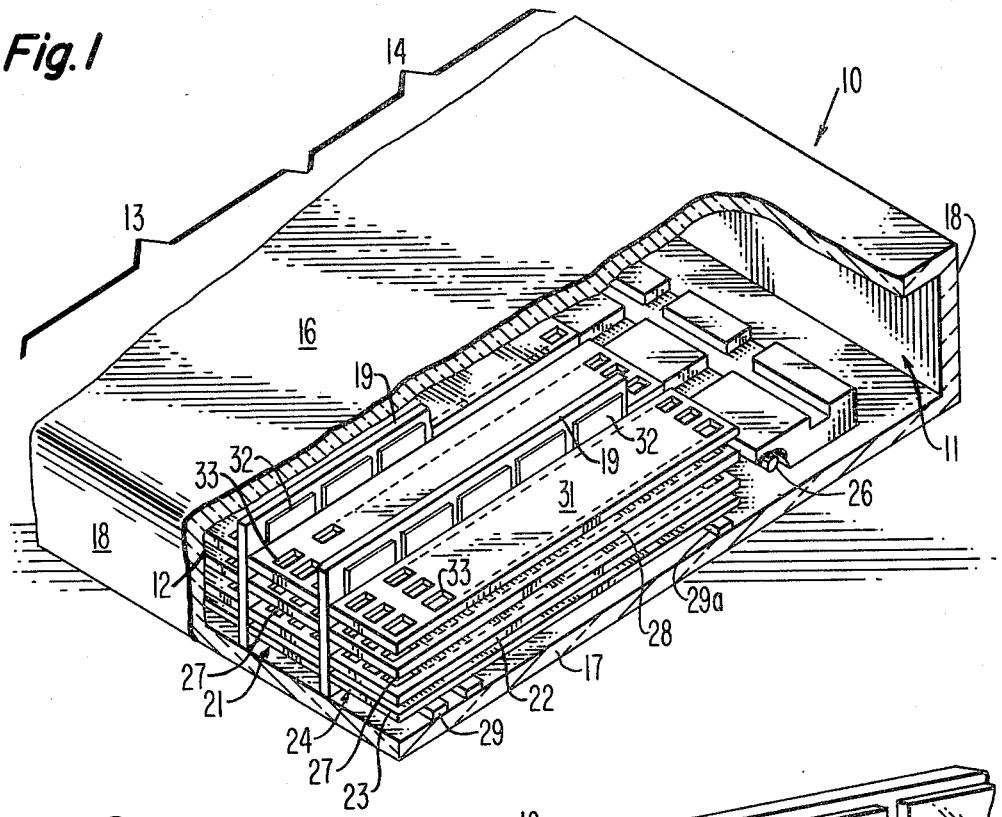
FIG. 1 is a simplified perspective view, partially broken away, showing the major components of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely across the channels and longitudinally along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 33 which also are aligned in columns longitudinally of the channels and in rows transversely of the channels. Segmented scanning electrodes 32 are arranged on both sides of the support vanes 19 so that each vane supports a scanning electrode for two adjacent channels.

In operation the electron beams propagate in the spaces 24 between the guide meshes 22 and 23 until the production of one line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 33 in the acceleration mesh 31 and the focus mesh 28. The extracted elecron beams are transversely scanned across the channels 21 by the application of varying voltages, such as sawtooth waveforms, to the scanning electrodes 32 on the sides of the support vanes 19. Every channel therefore is transversely scanned between the two support vanes 19 so that each channel contributes a portion of each line of the visual display on the faceplate 16.

Because all the electron beams pass the extraction electron 29*a*, which is nearest to the cathode 26, there is substantial opportunity for electrons to escape from between the meshes 22 and 23 and leak toward the screen 12 thereby degradating the visual display. The possibility of electron leakage therefore is unacceptably high in the vicinity of the cathode. Typically, 500 lines are scanned across the entire transverse dimension of the display. Accordingly, for each transverse line of the display, video information is displayed 1/500 of the total display time. For the extraction electrode 29*a* closest to the cathode 26 electron leakage can occur 499 times the display time of one line.

Figure 2:
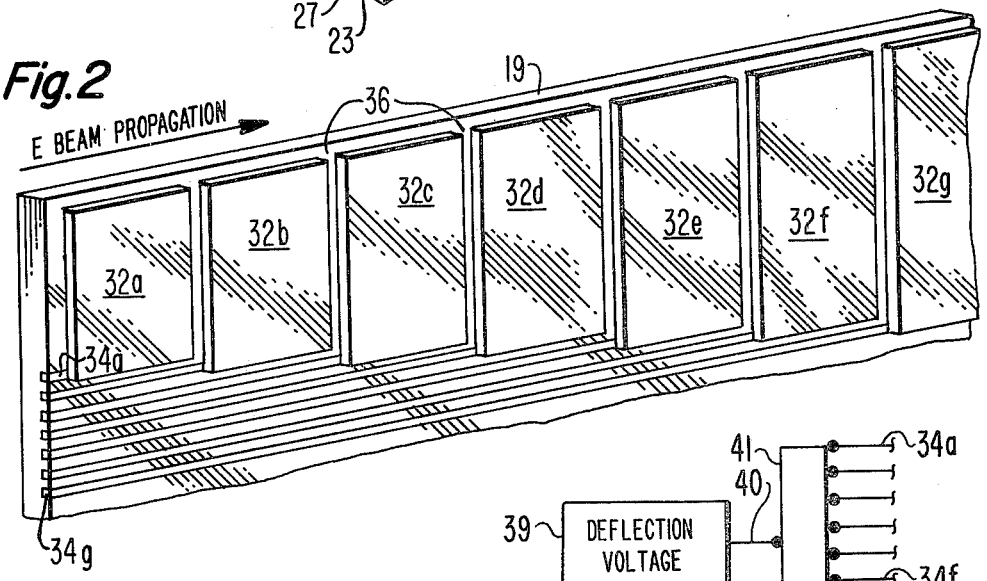
FIG. 2 is a perspective view, partially broken away, of a preferred embodiment of the instant invention.

The instant invention overcomes the electron leakage problem by segmenting the deflection electrodes 32 as shown in FIG. 2. The deflection electrode 32 is divided into a plurality of segments 32*a* through 32*g*. The dimension of the segments which is parallel to the direction of electron beam propagation within the beam guides, hereinafter called the width, is substantially equal. The segment 32*a* is closest to the cathode 26. All of the segments 32*a* through 32*g* are arranged so that the upper edges which are closest to the screen 16 are aligned. Additionally, the dimension of the segments which is parallel to a line extending from the screen 12 to the baseplate 19, hereinafter called the height, becomes progressively longer as the displacement from the cathode 26 increases.

A plurality of conductors 34*a* through 34*g* are respectively connected to the segments 32*a* through 32*g*. These conductors are used to couple the scanning and deflection voltages to the segments. The conductors 34*a* through 34*g* preferably are arranged between the baseplate 17 and the segments 32*a* through 32*g* because the electron beams as they are scanned across the channels are further away from the vanes 19 at this point.

In operation the scanning voltage which causes the electron beams to transversely scan the channels 21 is applied to the segment 32*g* most remote from the cathode by way of connector 34*g*. The other segments 32*a* through 32*f* are biased with a high negative voltage, such as 1 to 2 kV below the voltage on the screen. Accordingly, leakage electrons, which escape from between the guide meshes 22 and 23 and travel toward the screen 12, are deflected by the high negative voltage on one side of the channel to the segmented electrodes arranged transversely across the channel. The leakage electrons thus are prevented from reaching the screen 12 and degradating the visual display. The electron beams propagate along the channels to the segment 32*g* and then are extracted from between the meshes 22 and 23 to travel toward the screen 12. The electron beams are then scanned by the scanning voltage on segment 32*a* to form a line of the visual display transversely across the channel in the desired manner. This operation continues until all of the lines which are coincident with segment 32*g* have been produced and production of the lines coincident with segment 32*f* is to be commenced. At this time the high leakage prevention deflection voltage on segment 32*f* is replaced by the scanning voltage on segment 32*g*. At this time the scanning voltage is simultaneously applied to the segments 32*g* and 32*f* while the deflection voltage continues to be applied to the segments 32*a* through 32*e*. Accordingly, the scanning voltage is sequentially applied to the electrode segments and high deflection voltage is sequentially removed from the electrode segments until the display lines coincident with segment 32*a* are scanned and a completely visual display has been produced.

The spaces 36 between adjacent electrode segments are relatively small and therefore the deflection voltages have some influence on the electron beams being scanned across the channels. For this reason, switching from the deflection voltage to the scanning voltage preferably occurs before the preceding segment is fully scanned. Hence, switching to the scanning voltage preferably occurs at a time when approximately 75 percent of the preceding segment has produced a visual output.

The spaces between the electrode segments are small relative to the area of the electrodes and therefore a very large percentage of the deflected electrons will reach the electrodes and a very small number of electrons will go between the electrodes. A charge, therefore, can build up in the spaces between the electrodes. Such a charge buildup can be avoided by applying a resistive coating to both sides of the vanes 19 before the electrodes 32*a* to 32*g* are applied.

The decreasing heights of the segments 32*a* to 32*g* has no adverse effect on electron beam scanning because the conductors 34*a* to 34*g* also receive the scanning waveform. Thus, for example, when segment 32*e* is being scanned, segments 32*f* and 32*g* also are being scanned. The conductors 32*e*, 32*f* and 32*g* therefore also receive the scanning waveform and as a consequence the height of segment 32*e* in effect is increased by conductors 34*f* and 34*g*.

The number of scanning segments utilized is dependent upon the desired leakage improvement. Thus as the number of segments increases, the leakage improvement also increases. However, an upper limit exists because each segment affects the adjacent segments. Accordingly, when the propagation length of each channel is 30 inches (76.2 cm), a reasonable upper limit would be in the order of 15 segments, each segment being approximately 2 inches (5.0 cm) in width. However, 10 segments would be quite effective in leakage reduction and typically would be more practical because the number of connecting electrodes 34*a* through 34*g* would be decreased, thereby simplifying the switching circuitry.

Figure 3:
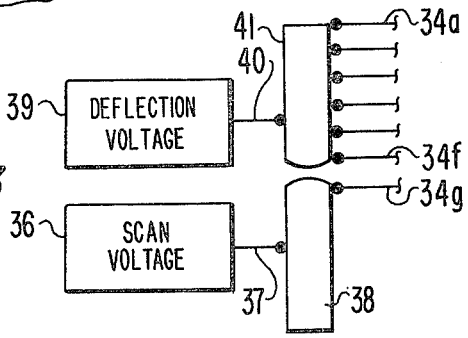
FIG. 3 is a simplified schematic showing of an exemplary switching mechanism for applying the scanning and deflection voltages to the scan electrodes.

A simplified schematic representation of a switching mechanism which can be used to bias the segmentedelectrodes is shown in FIG. 3. A scan voltage generator 36 produces a sawtooth or triangle waveform and is connected by an output line 37 to a conductive slide 38. The conductive slide 38 slidably contacts the conductor 34*g*. A deflection voltage generator 39 provides a large deflection voltage to another conductive slide 41 by way of the lead 40. The conductive slide 41 is in slidable contact with the remaining conductors 34*a* through 34*f*. Initially, the electron beams propagate along the channels 21 with the voltages applied to the segments 32*a* through 32*g* as shown in FIG. 3 so that transverse scanning occurs at segment 32*g* and leakage electrons are deflected. When the propagating electron beams reach the position where approximately the last 25 percent of the segment 32*g* has yet to produce visual display, the slide 38 slides into contact with the conductor 34*f* while the slide 41 simultaneously moves out of contact with the conductor 34*f*. With the switch in this condition, the segments 32*f* and 32*g* are both scanned by the varying voltages from scan generator 36 while the deflection voltage from the deflection voltage generator 39 continues to be applied to the segments 32*a* through 32*e*. This operation continues until the propagating electron beam is being scanned between the segments 32*a* at which time all of the segments 32*a* to 32*g* are connected to the scan voltage generator 36. The simplified schematic switching circuitry shown in FIG. 3 is used for illustration purposes only as in the actual device, this switching is done electronically by means well within the purview of one skilled in the art.

What is claimed is:

1. In an electron display device having an evacuated envelope including a faceplate, a backplate and a side wall, a phosphor screen on said faceplate, a plurality of vanes dividing said envelope into a plurality of channels, means for providing at least one electron beam, means in each of said channels for propagating said electron beam longitudinally along said channels substantially parallel to said screen, means extending along said backplate for selectively directing said electron beam toward said screen, and scanning means on said vanes for scanning said electron beam transversely across said channels so that each channel contributes a portion of a visual display on said screen, an improvement wherein:

said scanning means are electrode segments separated in the direction of said longitudinal electron beam propagation so that said electron beam sequentially propagates past said segments; and means for applying a varying voltage to a first portion of said segments to scan said electron beam transversely across said channels and means for applying a deflection voltage to a second portion of said segments to deflect leakage electrons away from said screen.

2. The display device of claim 1 wherein said varying voltage is sequentially applied to adjacent segments to increase the number of segments included in said first portion and wherein said deflection voltage is sequentially removed from segments to decrease the number of segments in said second portion at the same rate of increase of segments in said first portion.

3. The display device of claim 2 wherein said first portion is increased and said second portion is decreased when said electron beam is positioned with respect to the segment being scanned such that approximately 75 percent of said segment has produced a visual output.

4. The display device of claim 2 wherein said varying voltage is first applied to the segment furthermost from said means for providing at least one electron beam.

5. The display device of claim 1 further including leads substantially parallel to the length of said vanes for coupling said means for applying a varying voltage and said means for applying a deflecting voltage to said segments.

6. The display device of claim 5 wherein said leads are arranged between said segments and said backplate.

7. The display device of claim 6 wherein the dimension of adjacent segments along a line extending between said screen and said backplate progressively increases in the direction of said longitudinal propagation.

8. The display device of claim 7 wherein the sides of said segments nearest to said screen are aligned along a line parallel to said screen.

9. The display device of claim 3 or 4 further including a resistive coating on both sides of said vanes.

* * * * *